US006824237B2

(12) United States Patent
Hirayama et al.

(10) Patent No.: US 6,824,237 B2
(45) Date of Patent: Nov. 30, 2004

(54) PRINTHEAD, HEAD CARTRIDGE HAVING SAID PRINTHEAD, PRINTING APPARATUS USING SAID PRINTHEAD AND PRINTHEAD ELEMENT SUBSTRATE

(75) Inventors: Nobuyuki Hirayama, Kanagawa (JP); Tatsuo Furukawa, Kanagawa (JP); Yoshiyuki Imanaka, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/170,723

(22) Filed: Jun. 14, 2002

(65) Prior Publication Data

US 2003/0001911 A1 Jan. 2, 2003

(30) Foreign Application Priority Data

Jun. 15, 2001 (JP) ..... 2001-182461

(51) Int. Cl.[7] ..... B41J 28/39
(52) U.S. Cl. ..... 347/9; 347/57; 347/5
(58) Field of Search ..... 327/205, 217, 327/206, 215; 219/501, 216; 347/9, 57, 5

(56) References Cited

U.S. PATENT DOCUMENTS

| | | | | |
|---|---|---|---|---|
| 3,725,792 A | * | 4/1973 | Kellogg | 328/60 |
| 4,313,124 A | | 1/1982 | Hara | 346/140 R |
| 4,345,262 A | | 8/1982 | Shirato et al. | 346/140 R |
| 4,459,600 A | | 7/1984 | Sato et al. | 346/140 R |
| 4,463,359 A | | 7/1984 | Ayata et al. | 346/1.1 |
| 4,558,333 A | | 12/1985 | Sugitani et al. | 346/140 R |
| 4,723,129 A | | 2/1988 | Endo et al. | 346/1.1 |
| 4,740,796 A | | 4/1988 | Endo et al. | 346/1.1 |
| 4,994,687 A | * | 2/1991 | Fujii et al. | 307/291 |
| 5,801,576 A | | 9/1998 | Ooishi | 365/226 |
| 5,920,221 A | | 7/1999 | Shen et al. | 327/264 |
| 6,054,689 A | | 4/2000 | Imanaka et al. | 219/501 |

FOREIGN PATENT DOCUMENTS

| | | | | |
|---|---|---|---|---|
| EP | 0 694 391 A | | 1/1996 | |
| EP | 0 927 635 A | | 7/1999 | |
| JP | 362007216 A | * | 1/1987 | 327/206 |
| JP | 8-39809 | | 2/1996 | |
| JP | 8-039809 | | 2/1996 | |

* cited by examiner

*Primary Examiner*—Hai Pham
*Assistant Examiner*—Lam Nguyen
(74) *Attorney, Agent, or Firm*—Fitzpatrick, Cella, Harper & Scinto

(57) ABSTRACT

A printhead has a plurality of printing elements and a drive circuit for driving the printing elements aligned in a predetermined direction on an element board. The printhead is provided with a Schmitt trigger having hysteresis properties that give different threshold values to the rising and falling edges of a waveform of a logic signal (HE, LT, CLK, DATA) input into the drive circuit. The Schmitt trigger is provided with means for adjusting the length of the delay at the rising and falling edges of the input waveform signal, so that the speed of data transmission to the printhead can be increased even as the supply voltage is lowered.

17 Claims, 17 Drawing Sheets

PRINTHEAD, HEAD CARTRIDGE HAVING SAID PRINTHEAD, PRINTING APPARATUS USING SAID PRINTHEAD AND PRINTHEAD ELEMENT SUBSTRATE

FIELD OF THE INVENTION

The present invention relates to a printhead, head cartridge having said printhead, printing apparatus using said printhead and printhead element substrate, and more particularly, to a printhead having a plurality of painting elements and a drive circuit for driving the printing elements aligned in a predetermined direction on an element board, a head cartridge having such a printhead, a printing apparatus using such a printhead, and a printhead substrate.

BACKGROUND OF THE INVENTION

In a printing apparatus used as an information output device for a word processor, personal computer or facsimile network and the like to print desired text or image information on paper, film or some other sheet-like printing medium, a serial printing method is in general and widespread use due to its inexpensiveness and ability to be made compact.

In order to facilitate an understanding of the present invention, a description will now be given of the composition of the printhead used in such a printing apparatus, using the example of a printhead that follows the ink jet method that uses thermal energy to print. For the printing element, this type of ink jet printhead provides heating elements, or heaters, at that portion of the head that is continuous with the nozzles that actually discharge the drops of ink. An electric current is then applied to the heaters, causing the heaters to boil the ink and forcing ink drops through the nozzles by the expansion of the bubbles formed in the ink when boiled. This type of printhead easily accommodates compact, high-density arrangements of nozzles and heaters, by means of which high-definition printing images can be obtained.

The heater board of the printhead of a printer that uses heaters for the heating element is supplied with power from the printer main unit by two power supply systems: a 10–30V, high-voltage power supply for driving the heaters, and a 5V power supply for the logic circuits that control the driving of the heaters.

The heater power source VH, together with the signal supplied to the logic circuit, is connected to the heater board from the printer via flexible substrate wiring that connects the main unit and the carriage, a contact pad (connection terminal) on the carriage that connects to the head, and tab wiring inside the printhead. The wiring and contact pad have resistance, inductance and capacitance impedance components, so fluctuations in current as the heater turns ON and OFF causes large, precipitous fluctuations in the heater power source VH voltage. This voltage fluctuation is superimposed on the logic signal via the flexible substrate wiring.

In order to prevent faulty operation of the heater board logic circuit due to the effects of noise mixed in with the logic signal, the input part of the logic circuit is provided with a Schmitt trigger that gives the threshold voltage for discriminating between high-level and low-level logic signals a hysteresis property as between the rising waveform and the falling waveform of the input signal.

FIG. 1 is a block diagram showing the circuit structure of a heater board of a typical ink jet printhead. From the printer main unit, a heater drive signal HE, latch signal LT, clock signal CLK and data signal DATA, respectively, are input from respective contact pads 510. The data signal DATA is synchronized with the clock signal CLK and input into a shift register, and is held in a latch 505 with the input of the latch signal LT. The logical product of the output from the latch 505 and the heater drive signal (HE) is ANDED by an AND circuit 504, and depending on that output the drive element 502 is turned ON via a buffer 503 and a heater 501 is activated (that is, driven).

In an ink jet printhead heater board circuit, a Schmitt trigger 508 is provided between each of the signal contact pads 510 and buffers 507. The Schmitt trigger used in this type of circuit may be that which is described in Japanese Laid-Open Patent Application No. 08-039809.

A description will now be given of the operation of a Schmitt trigger with reference to FIGS. 2A and 2B, in a case in which the supply voltage Vdd is 5 V and the signal waveform rising and falling threshold voltages are 3.5 V and 1.5 V, respectively.

FIGS. 2A and 2B are diagrams illustrating a Schmitt trigger and the operating characteristics thereof.

In FIG. 2A, reference numeral 100 denotes a MOS inverter with a threshold of 3.5 V (that is, 70% of the supply voltage Vdd), reference numeral 101 denotes a MOS inverter with a threshold of 1.5 V (that is, 30% of the supply voltage Vdd) and reference numeral 102 denotes a MOS inverter with a threshold of 2.5 V (that is, 50% of the supply voltage Vdd). Reference numerals 103 and 104 are NAND circuits, respectively.

The input-output characteristics of this circuit are as shown in FIG. 2B, in which, when a signal indicated by dotted line 10 is input, a flip-flop composed of NAND circuits 103 and 104 is initially reset and the output signal 111 is LOW. Then, when the input signal 110 exceeds 0.7 Vdd, the inverter 100 output becomes LOW, the NAND circuit 103 output becomes HIGH and the output signal 111 is HIGH. Next, when the input signal 110 voltage drops and the electric potential falls below 0.3 Vdd, the inverter 101 output inverts and switches to HIGH and the NAND circuit 104 output inverts to LOW, making the output signal 111 LOW.

Next, a description will be given of the composition of a signal that changes the threshold values of the MOS inverters 100 and 101, with reference to FIG. 3.

FIG. 3 shows the layout of a MOS inverter. As shown in the diagram, L and W show the length and width, respectively, of the MOS-construction FET gate. Additionally, reference numeral 120 denotes an input signal line input from the pad and reference numeral 121 denotes the output signal line.

In a typical MOS inverter, the ON resistance of the PMOS and NMOS is practically identical, and is designed so that the threshold is a central 0.5 Vdd. By changing the length L and width W of the gate shown in FIG. 3, the channel resistance value can be increased or decreased. Accordingly, with respect to the inverter 100 of FIG. 2A, the length and width of the gate are set so that the ON resistance (NMOS) is greater than the ON resistance (PMOS), and with respect to the inverter 101, the length and width of the gate are set so that the ON resistance (NMOS) is less than the ON resistance (PMOS). As a result, as shown by the hysteresis characteristic of FIG. 2B, inverter circuits of different threshold values can be formed on the same heater board by any common logic circuit production process.

Next, a description will be given of the Schmitt trigger having hysteresis characteristics and formed by using two inverters of different thresholds as described above, with reference once again to FIG. 2A.

Reference numeral 106 in FIG. 2A denotes an input pad and P1–P6 denote points for indicating a voltage or a logic level. When the electric potential of the signal input from the input pad 106 changes from 0 V to 1.5 V, because the inverter 101 input signal threshold is 1.5 V the electric potential at point P3 changes from HIGH to LOW and the electric potential at point P4 also changes from LOW to HIGH.

Further, when the electric potential of the signal input from the input pad 106 changes from 1.5 V to 3.5 V, because the inverter 100 input threshold is 3.5 V the inverter 100 output inverts and the electric potential at point P2 becomes LOW. As a result, the NAND circuit output (PS) electric potential level inverts to HIGH. Thus it is clear that the output P5 becomes HIGH only after the input signal electric potential is 3.5 V. In this state, the output signal level is maintained even if the electric potential at the input pad rises further.

If the electric potential of the signal input from the input pad 106 falls from 5 V to 0 V, then the inverter 100 with an input threshold of 3.5 V inverts before the inverter 101 when the electric potential at point P1 is 3.5 V. In this case, however, because the electric potential at point P6 is LOW there is no impact from the output P5. Then, when the electric potential at the input pad falls to 1.5 V, the inverter 101 inverts, the output (point P3) of that inverter 101 becomes HIGH, the point P4 electric potential becomes LOW and the output P5 changes to LOW.

As described above, by giving the printhead heater board input signal a hysteresis characteristic, a hysteresis characteristic with a higher noise margin can be obtained in which the input signal level can rise to 3.5 V without the output inverting when the input signal is LOW (0 V) and the input signal can fall to 1.5 V or less without the output inverting when the input signal is HIGH (3.5 V or more).

However, a parallel interface is usually used for the conventional printer interface. In that case, a voltage of 5 V is used as the power source for the logic circuitry of the printer main unit, and that 5 volts is also used to supply power to the logic circuitry of the ink jet printhead substrate inside the head. Additionally, a portion of the integrated circuits of the printer's internal circuitry also requires a power supply of 5 V, which is one reason the logic voltage of the ink jet printhead substrate has been designed to be 5 V.

However, recently, improvements in the miniaturization technologies that lay down IC design rules and the adoption of new interfaces have made the use of a 5 V printer main unit power supply increasingly impractical in terms of cost and size. It is for this reason that there have been moves afoot to adopt 3.3 V as the mainstream printer main unit logic supply voltage. Nevertheless, it has been established that reducing the head substrate logic supply voltage from the proven 5 V to 3.3 V creates a number of problems, which are described below with reference to FIG. 4.

FIG. 4 is an example of the structure of the substrate (hereinafter also referred to as an "element board") used for a typical ink jet printhead. In the diagram, reference numeral 1003 is a pad for receiving an external signal. As shown in the diagram, the pad 1003 includes a Vdd terminal 1006 for receiving a logic supply voltage, a VH terminal 1008 for receiving a heater drive supply voltage, a GNDH terminal 1005 that is grounded, and a VSS terminal 1007. Additionally, as shown in the diagram, a shift register logic circuit 1002 for receiving image data serially and outputting such data in parallel, a driver 1001 for driving a heater and a heater 1004 are arranged on a single silicon substrate.

A case involving formation of a 620-bit heater is depicted in further detail in FIG. 5.

FIG. 5 is a block diagram of an ink jet printhead substrate.

As shown in the diagram, the 620-bit heater is designed so as to drive a maximum of 40 bits simultaneously, repeated 16 times so as to drive all of the 620-bit heaters (in one cycle).

FIG. 6 is a drive timing chart for an ink jet printhead. A description will now be given with reference to FIG. 6 of the speed required to send image data when driving all 620 bits, where the drive frequency required to carry out constant high-speed printing is 15 kHz (existing equipment will suffice for this purpose).

A drive frequency of 15 kHz results in a period (cycle) of 66.67 $\mu$S, within which 40 bits of image data must be sent in 16 blocks, which means that the image data transmission speed must be at least 12 MHz or more. This transmission speed is not large when considered within the context of the capabilities of an ordinary CPU, but in the case of an ink jet printhead, the fact that the working carriage and the main unit are connected by a long, flexible element board and that printers themselves have become smaller requires the carriage to be made more compact as well. As a result, the 12 MHz figure is by no means a small one.

A description of the reduction in transmission capacity when the logic supply voltage is reduced from 5 V to 3.3 V will now be given with reference to FIGS. 7A and 7B.

FIGS. 7A and 7B are diagrams showing logic supply voltages versus image data transmission-capable maximum clock frequencies and element board temperature versus image data transmission-capable maximum clock frequencies, respectively.

As shown in the diagrams, as the logic signal supply voltage drops the clock frequency declines, because the drive performance of the MOS transistor used for the shift register part and the clock and other input circuitry for performing image data transmission declines simultaneously with the decline in the logic supply voltage used as the gate voltage of the CMOS. As can be understood from the diagrams, the drop in gate voltage causes the drive performance (that is, the drain current $I_d$) to decline.

Moreover, driving the heaters on the element board of the ink jet printhead imposes thermal requirements on top of speed requirements. These added thermal requirements are specific to ink jet printhead substrates. Thus, as shown in FIG. 7B, the performance of the ink jet printhead declines as the temperature of the element board increases together with the decline in capacity attendant upon use of a 3.3 V power supply.

From the foregoing, it is clear that the performance must be enhanced with the 3.3 V arrangement, in a way that was not an issue for the conventional 5 V, 12 MHz clock frequency.

In order to facilitate an understanding of the present invention, a further description will now be given of the cause of the above-described decline in image data transmission capacity with a Schmitt trigger as the voltage is lowered.

As the power supply voltage is lowered, the gate voltage that drives the MOS transistor that composes the logic circuit also declines.

FIG. 8 is a graph showing the relation between drain current ($I_d$) and drain-source voltage ($V_{ds}$) in a MOS transistor when the gate voltage ($V_{gs}$) is varied.

As can be seen from FIG. 8, when the gate voltage ($V_{gs}$) drops from 5 V to 3.3 V, the transistor current drive capacity declines by over half.

FIG. 9 is a diagram showing the gate capacity load added to the inverter output when a CMOS inverter is used to drive a MOS transistor gate.

If a MOS transistor gate is driven with a CMOS inverter as shown in FIG. 9, then in effect the gate capacity load is added to the inverter output. If the MOS ON resistance is RMOS and the equivalent load capacity is $C_{gate}$, then the delay time constant from the time the inverter input changes to the time the output inverts is $C_{gate}$ X RMOS. Lowering the supply voltage without changing the load more than doubles the RMOS, and thus also more than doubles the delay time constant.

In the Schmitt trigger depicted in FIG. 2A, from input of the Schmitt trigger to output, the number of steps of the operating inverter differs between the rising waveform and the falling waveform, and it is for this reason that the delay time of the inverters increases as the voltage is lowered, which in turn causes the length of the delay of the Schmitt trigger with respect to the input waveform rising edge and falling edge to differ from the conventional delay by as much as a factor of two or more.

When the supply voltage is 5 V the ON resistances are sufficiently small that the difference between the rising delay and the falling delay is minor and can be ignored. However, reducing the supply voltage also reduces the drive gate voltage in an MOS transistor, increasing the ON resistance and, as a result, increasing the difference in the extent of the rising delay and the falling delay to the point where the difference can no longer be ignored.

A difference in the delay between the rising edge and the falling edge of an input waveform in a Schmitt trigger leads to the following problems.

FIG. 10 shows a Schmitt trigger signal waveform in which a delay is imposed at the rising and falling edges of an input signal.

As shown in the diagram, the input signal waveform is indicated by a solid line and the shift register waveform is indicated by a dashed line. As is clear from the solid line indicating the input signal waveform, the set-up time and the hold time that comprise the margin of DATA change with respect to changes in the CLK is the same for the input waveform. However, as shown by the dashed line indicating the shift register waveform, a waveform that has passed through a Schmitt trigger has a reduced set-up time and hold time as compared to those of the input waveform.

When the set-up time and the hold time margins decrease at the shift register input as described above, reliable data acquisition becomes problematic, which can cause malfunctions. Additionally, it becomes difficult to increase the clock frequency and carry out high-speed data acquisition.

Additionally, the heater board is a part of the printhead which is an expendable component, so it is used in common in a wide variety of printers and existing layouts. As a result, circuit configurations have been studied extensively in terms of reducing costs and streamlining manufacturing, that is, standardizing the product. Accordingly, adding a new component as a result of lowering the supply voltage imposes not only a requirement to not complicate the manufacturing process but also a requirement to study such an addition carefully in order to not upset the overall balance.

Moreover, recent demands for and improvements in printer printing speed and printing resolution continue to grow apace, with the result that consumers still require improved printing speed even with a lowered supply voltage.

SUMMARY OF THE INVENTION

Accordingly, the present invention was developed in order to solve the problems of the conventional art described above, and has as its object to provide a printhead that, when operating with a lowered supply voltage, can reduce the difference in delay between the rising edge and the falling edge of an input waveform between the input and output of a Schmitt trigger and can accommodate high-speed data transmission, while imposing no additional manufacturing costs.

Another object of the present invention is to provide a head cartridge adapted to use the above-described printhead.

Another and further object of the present invention is to provide a printing apparatus that uses the above-described printhead.

Still another and further object of the present invention is to provide a printhead element substrate that reduces the difference in delay at the rising edge and the falling edge of a given input waveform at the Schmitt trigger between input and output without increasing manufacturing costs when the supply voltage is lowered, and can accommodate high-speed data transmission.

The above-described objects of the present invention are achieved by a printhead in which a plurality of printing elements and a drive circuit for driving the printing elements are provided on a single element substrate, the printhead comprising a Schmitt trigger having hysteresis characteristics that cause a threshold value for a rising edge of a waveform of a logic signal input into the drive circuit and a threshold value of a falling edge of a waveform of a logic signal input into the drive circuit to be different, and delay adjustment means for adjusting a length of a delay at the rising edge and a length of a delay at the falling edge occurring when the threshold values of the rising edge and the falling edge of the input signal waveform differ.

Additionally, the above-described objects of the present invention are achieved by a head cartridge comprising the printhead as described above, and an ink tank adapted to hold ink to be supplied to the printhead.

Additionally, the above-described objects of the present invention are achieved by a printing apparatus comprising the printhead described above, wherein the printing apparatus performs printing using the printhead.

Additionally, the above-described objects of the present invention are achieved by a printhead element substrate, in which a plurality of printing elements and a drive circuit for driving the printing elements are provided on a single element substrate, the printhead element substrate comprising a Schmitt trigger having hysteresis characteristics that cause a threshold value for a rising edge of a waveform of a logic signal input into the drive circuit and a threshold value of a falling edge of a waveform of a logic signal input into the drive circuit to be different, and delay adjustment means for matching a length of a delay at the rising edge and a length of a delay at the falling edge occurring inside the Schmitt trigger at the rising edge and the logic signal.

In other words, in the present invention, the delays at the rising and falling edges of the input waveform of the logic signals input to the drive circuit are adjusted at the Schmitt trigger.

By so doing, the two delays can be made substantially identical, so the speed of data transmission to the printhead can be increased even as the supply voltage is lowered.

It should be noted that it is preferable that the data be read at the rising and falling edges of the logic signals.

In such cases, the logic signals consist of at least a clock signal and a data signal.

Optimally, the delay adjustment means is provided inside the Schmitt trigger.

It is preferable that a Schmitt trigger be provided for each logic signal to be input to the drive circuit.

In such a case, the Schmitt trigger may be configured so that the number of elements along the path traversed by the rising edge of the logic signal and the number of elements provided along the path traversed by the falling edge of the logic signal is different, with the delay adjustment means being provided along the path of fewer elements.

Specifically, the Schmitt trigger may be configured so that the number of inverters included in the path traversed by the falling edge of the logic signal is greater than the number of inverters included in the path traversed by the rising edge of the logic signal, and the delay adjustment means is provided along the path traversed by the rising edge of the logic signal.

Alternatively, the Schmitt trigger may be configured so that the number of inverters included in the path traversed by the falling edge of the logic signal is greater than the number of inverters included in the path traversed by the rising edge of the logic signal, and the length of the delay at a rising edge of the waveform logic signal and the length of the delay at the falling edge of the waveform logic signal is adjusted by adjusting an ON resistance of at least one inverter included in one path or the other.

Preferably, the length of the delay at the rising edge and the length of the delay at the falling edge are adjusted to be substantially identical.

Other objects, features and advantages of the present invention besides those discussed above shall be apparent to those skilled in the art from the description of a preferred embodiment of the invention which follows. In the description, reference is made to accompanying drawings, which form a part thereof, and which illustrate an example of the invention. Such example, however, is not exhaustive of the various embodiments of the invention, and therefore reference is made to the claims that follow the description for determining the scope of the invention.

DETAILED DESCRIPTION OF THE PREFERRED EMBODIMENTS

Preferred embodiments of the present invention will now be described in detail in accordance with the accompanying drawings.

In the following embodiments, a printer is described as an example of a printing apparatus using an ink-jet system.

In this specification, "print" means not only to form significant information such as characters and graphics, but also to form, e.g., images, figures, and patterns on printing media in a broad sense, regardless of whether the information formed is significant or insignificant or whether the information formed is visualized so that a human can visually perceive it, or to process printing media.

"Print media" are any media capable of receiving ink, such as cloth, plastic films, metal plates, glass, ceramics, wood, and leather, as well as paper sheets used in common printing apparatuses.

Furthermore, "ink" (also to be referred to as a "liquid" hereinafter) should be broadly interpreted like the definition of "print" given above. That is, ink is a liquid which is applied onto a printing medium and thereby can be used to form images, figures, and patterns, to process the printing medium, or to process ink (e.g., to solidify or insolubilize a colorant in ink applied to a printing medium).

A "substrate" (also to be referred to as an "clement board" hereinafter) includes not only a base plate made of a silicon semiconductor but also a base plate bearing elements and wiring lines.

The expression "on a substrate" can mean on or at the surface of a substrate or the inside of a substrate near its surface, in addition to on a substrate. "Built-in" in the present invention does not refer to a simple layout of separate elements on a base, but refers to integral formation/manufacture of elements on a substrate by a semiconductor circuit manufacturing process.

In order to facilitate an understanding of the present invention, a general description will first be given of the structure of a typical ink jet printer using the printhead according to the present invention.

<Brief Description of a Printing Apparatus>

Figure 11:
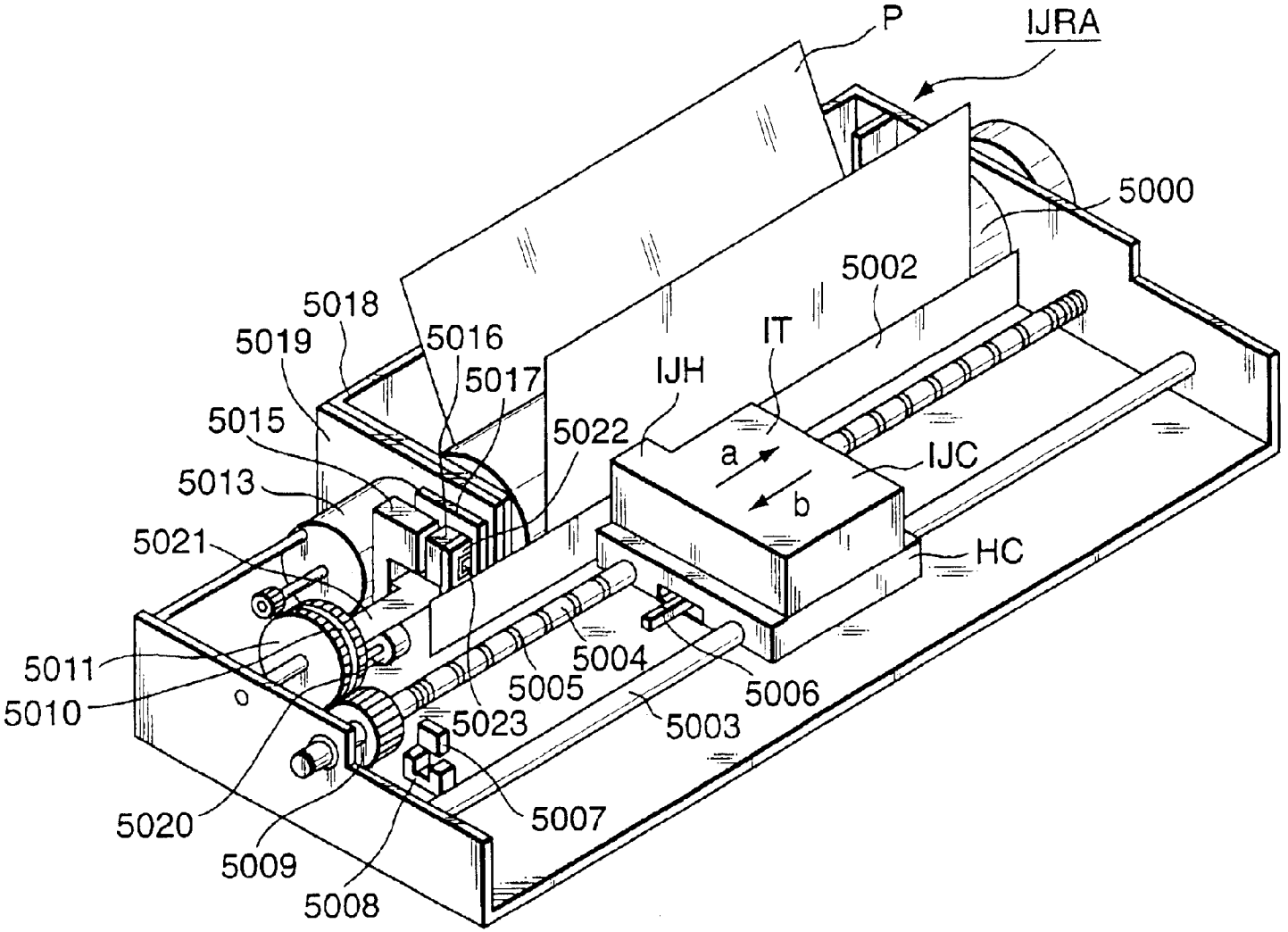
FIG. 11 is a perspective view showing an outer appearance of the construction of a printing apparatus according to the present invention.

FIG. 11 is a perspective view showing the outer appearance of an ink-jet printer IJRA as a typical embodiment of the present invention. Referring to FIG. 11, a carriage HC engages with a spiral groove 5004 of a lead screw 5005, which rotates via driving force transmission gears 5009 to 5011 upon forward/reverse rotation of a drive motor 5013.

The carriage HC has a pin (not shown), and is reciprocally moved in directions of arrows a and b in FIG. 11. An integrated ink-jet cartridge IJC which incorporates a printing head IJH and an ink tank IT is mounted on the carriage HC.

Reference numeral 5002 denotes a sheet pressing plate, which presses a paper sheet against a platen 5000, ranging from one end to the other end of the scanning path of the carriage. Reference numerals 5007 and 5008 denote photocouplers which serve as a home position detector for recognizing the presence of a lever 5006 of the carriage in a corresponding region, and used for switching, e.g., the rotating direction of motor 5013.

Reference numeral 5016 denotes a member for supporting a cap member 5022, which caps the front surface of the printing head IJH; and 5015, a suction device for suctioning ink residue through the interior of the cap member. The suction device 5015 performs suction recovery of the printing head via an opening 5023 of the cap member 5015. Reference numeral 5017 denotes a cleaning blade; 5019, a member which allows the blade to be movable in the back-and-forth direction of the blade. These members are supported on a main unit support plate 5018. The shape of the blade is not limited to that shown, and any known cleaning blade can be used in this embodiment instead.

Reference numeral 5021 denotes a lever for initiating a suction operation in the suction recovery operation. The lever 5021 moves upon movement of a cam 5020, which engages with the carriage, and receives a driving force from the driving motor via a known transmission mechanism such as clutch switching.

The capping, cleaning, and suction recovery operations are performed at their corresponding positions upon operation of the lead screw 5005 when the carriage reaches the home-position side region. However, the present invention is not limited to this arrangement, as long as desired operations are performed at known timings.

<Description of a Control Arrangement>

Next, the control structure for performing the printing control of the above apparatus is described.

Figure 12:
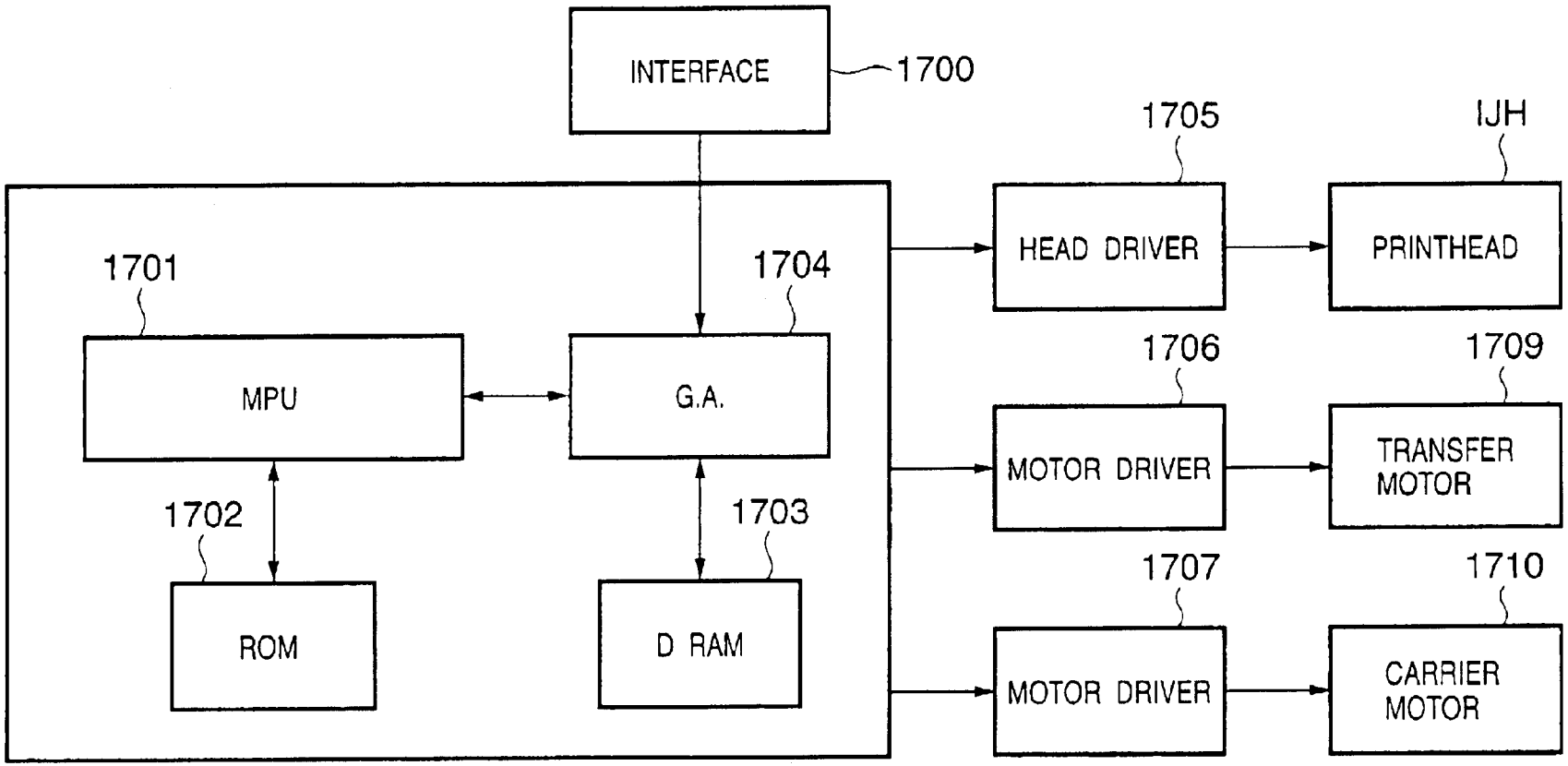
FIG. 12 is a block diagram showing an arrangement of a control circuit of the printing apparatus shown in FIG. 11.

FIG. 12 is a block diagram showing the arrangement of a control circuit of the ink-jet printer. Referring to FIG. 12 showing the control circuit, reference numeral 1700 denotes an interface for inputting a print signal from an external unit such as a host computer; 1701, an MPU; 1702, a ROM for storing a control program (including character fonts if necessary) executed by the MPU 1701; and 1703, a DRAM for storing various data (the print signal, print data supplied to the printing head and the like). Reference numeral 1704 denotes a gate array (G. A.) for performing supply control of print data to the printing head IJH. The gate array 1704 also performs data transfer control among the interface 1700, the MPU 1701, and the DRAM 1703. Reference numeral 1710 denotes a carrier motor for transferring the printing head IJH in the main scanning direction; and 1709, a transfer motor for transferring a paper sheet. Reference numeral 1705 denotes a head driver for driving the printing head; and 1706 and 1707, motor drivers for driving the transfer motor 1709 and the carrier motor 1710.

The operation of the above control arrangement will be described below. When a print signal is inputted into the interface 1700, the print signal is converted into print data for a printing operation between the gate array 1704 and the MPU 1701. The motor drivers 1706 and 1707 are driven, and the printing head is driven in accordance with the print data supplied to the head driver 1705, thus performing the printing operation.

Though the control program executed by the MPU 1701 is stored in the ROM 1702, an arrangement can be adopted in which a writable storage medium such as an EEPROM is additionally provided so that the control program can be altered from a host computer connected to the ink-jet printer IJRA.

Note that the ink tank IT and the printing head IJH are integrally formed to construct an exchangeable ink cartridge IJC; however, the ink tank IT and the printing head IJH may be separately formed such that, when ink is exhausted, only the ink tank IT need be exchanged for a new ink tank.

[Ink Cartridge]

Figure 13:
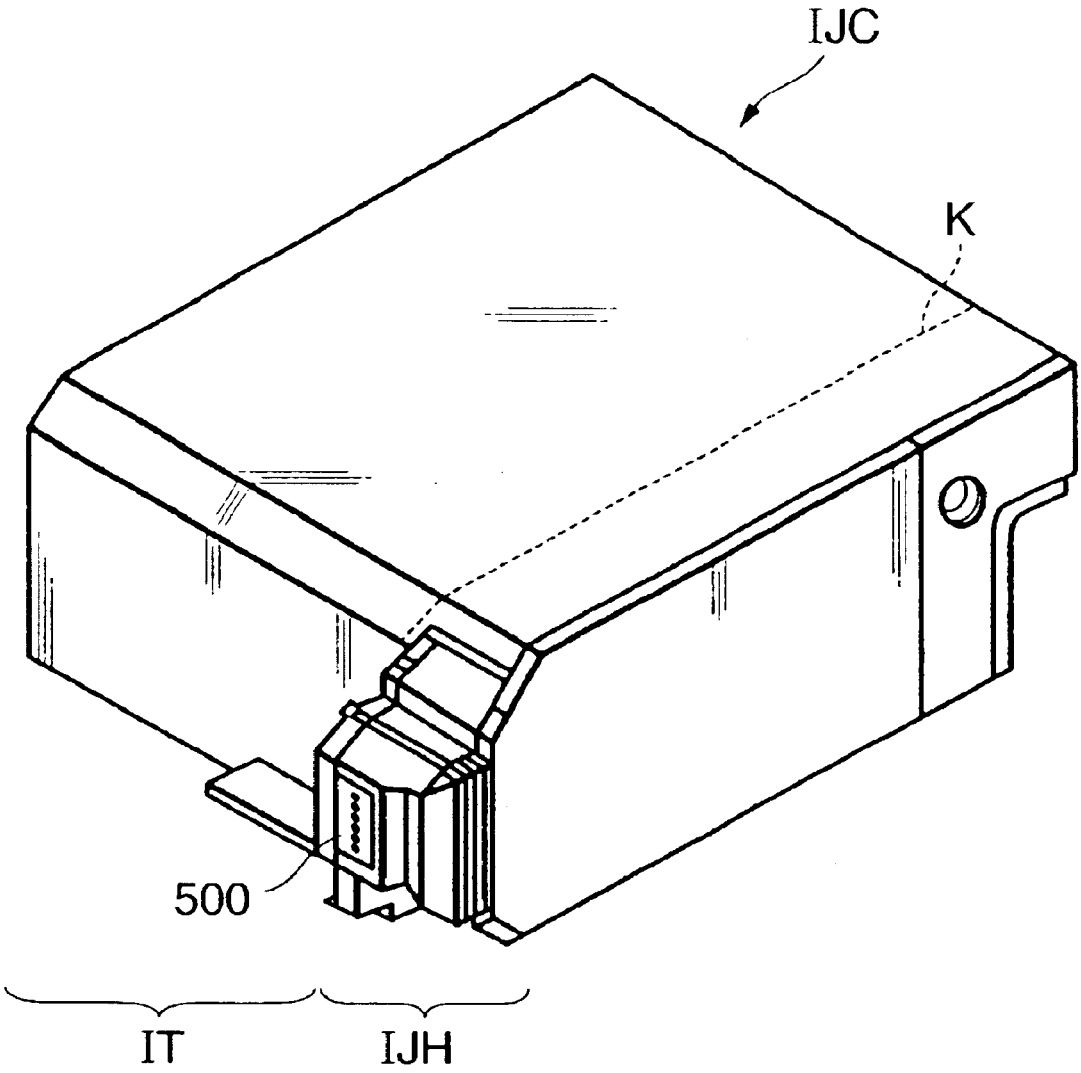
FIG. 13 is a perspective view showing an outer appearance of an ink cartridge of the printing apparatus shown in FIG. 11.

FIG. 13 is a perspective view showing the structure of the ink cartridge IJC where the ink tank and the head can be separated. As shown in FIG. 13 in the ink cartridge IJC, the ink tank IT and the printing head IJH can be separated along a line K. The ink cartridge IJC has an electrode (not shown) for receiving an electric signal supplied from the carriage HC side when it is mounted on the carriage HC. By the electric signal, the printing head IJH is driven as above, and discharges ink.

Note that in FIG. 13, numeral 500 denotes an ink-discharge orifice array. Further, the ink tank IT has a fiber or porous ink absorbing body. The ink is held by the ink absorbing body.

[Printhead]

A description will now be given of embodiments of an ink jet printer printhead having the structure described above, with reference to the Schmitt trigger and other circuitry disposed on the substrate (element board).

It should be noted that a member that forms a flow path continuous with ink discharge orifices that correspond to the printing elements is provided on the substrate, together with ink discharge orifices.

The ink that is supplied to these printing elements is then heated by the driving of the printing elements so as to form air bubbles in the surface of the ink, thus discharging the ink from the ink discharge orifices.

[First Embodiment]

A description will now be given of a printhead according to a first embodiment of the present invention.

Figure 14:
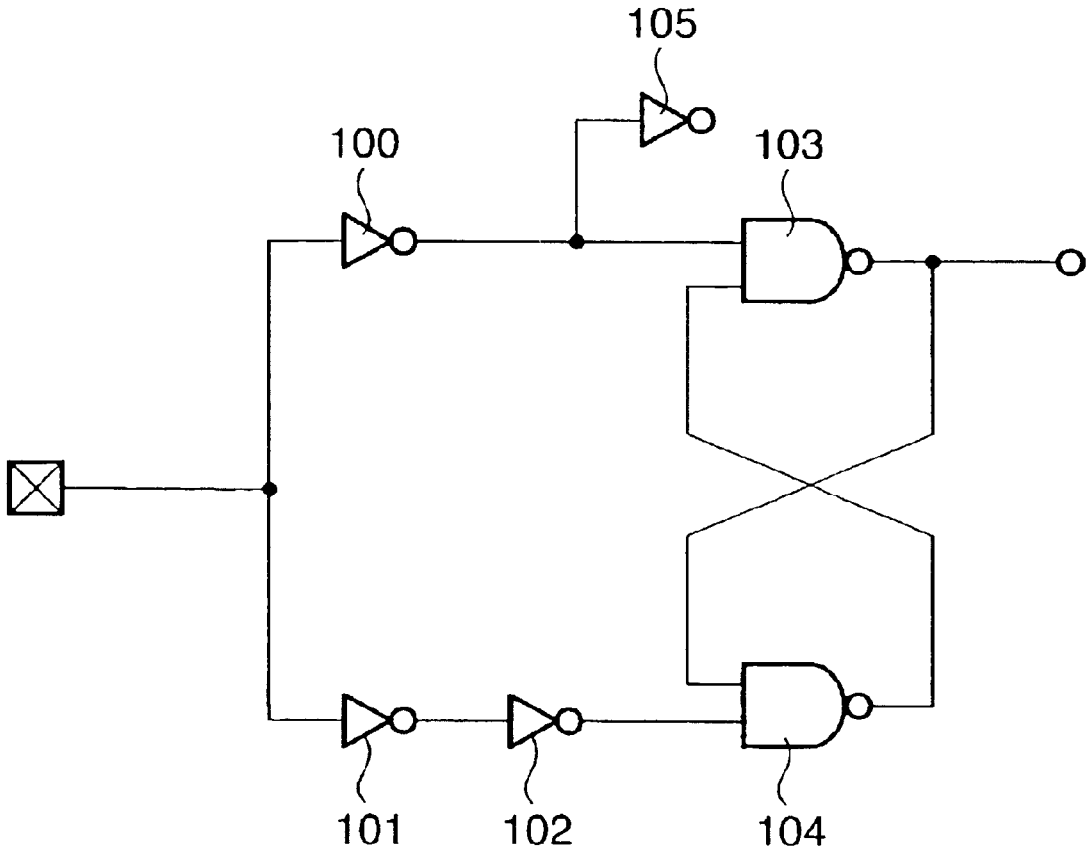
FIG. 14 is a circuit diagram showing the structure of a Schmitt trigger of a printhead according to a first embodiment of the present invention.

FIG. 14 is a circuit diagram showing the structure of a Schmitt trigger of the printhead according to the first embodiment of the present invention. As a means of adjusting the delay of the rising and falling waveform signals at the Schmitt trigger depicted in FIG. 2A, the present invention is provided with an additional inverter 105 connected to the output of inverter 100.

Assume the ON resistance when driven of inverters 100, 101 and 102 is R100, R101 and R102, respectively. Similarly, assume the input capacity of inverters 102 and 105 and of AND gates 103 and 104 is C102, C105, C103 and C104, respectively. If it is assumed that the delay when the MOS transistor is driven is proportional to the product of the capacity connected to the transistor output and the ON resistance, then the delay in the rising signal and the delay in the falling signal will be as follows.

Time delay rising Tr:

$$Tr \propto R100 \times (C103 + C105) \quad (1)$$

Time delay falling Tf:

$$Tf \propto R101 \times C102 + R102 \times C104 \quad (2)$$

Where Tr=Tf, then:

$$R100 \times (C103 + C105) = R101 \times C102 + R102 \times C104 \quad (3)$$

Accordingly, in terms of C105:

$$C105 = ((R101 \times C102 + R102 \times C104)/R100) - C103 \quad (4)$$

Therefore, setting the input capacity of inverter 105 so as to satisfy the terms of equation (4) above eliminates the difference in the delays of the rising and falling signals at the Schmitt trigger, thereby allowing the system to accommodate upgrades to high-speed data transfer.

Additionally, the Schmitt trigger of the present embodiment is one in which the inverter 105 which has been added to the circuit has the same structure as that which is used with conventional circuits. Therefore, the present embodiment can be formed on the heater board using the same manufacturing techniques as are used conventionally, thus keeping cost increases associated with the present embodiment to a minimum.

[Second Embodiment]

A description will now be given of a printhead according to a second embodiment. Such description concentrates on the distinctive features of the second embodiment, and so a description of elements of the second embodiment that are identical to those of the first embodiment described above is omitted.

Figure 15:
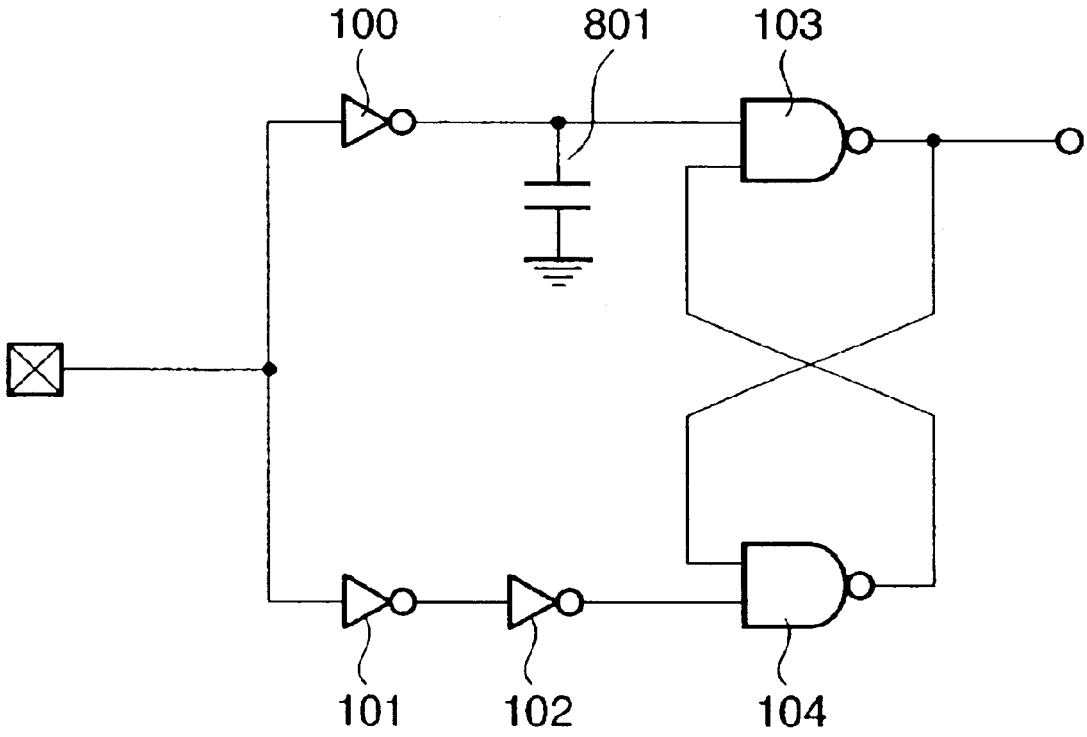
FIG. 15 is a circuit diagram showing the structure of a Schmitt trigger of a printhead according to a second embodiment of the present invention.

FIG. 15 is a circuit diagram showing the structure of a Schmitt trigger of the printhead according to the second embodiment of the present invention.

Figure 1:
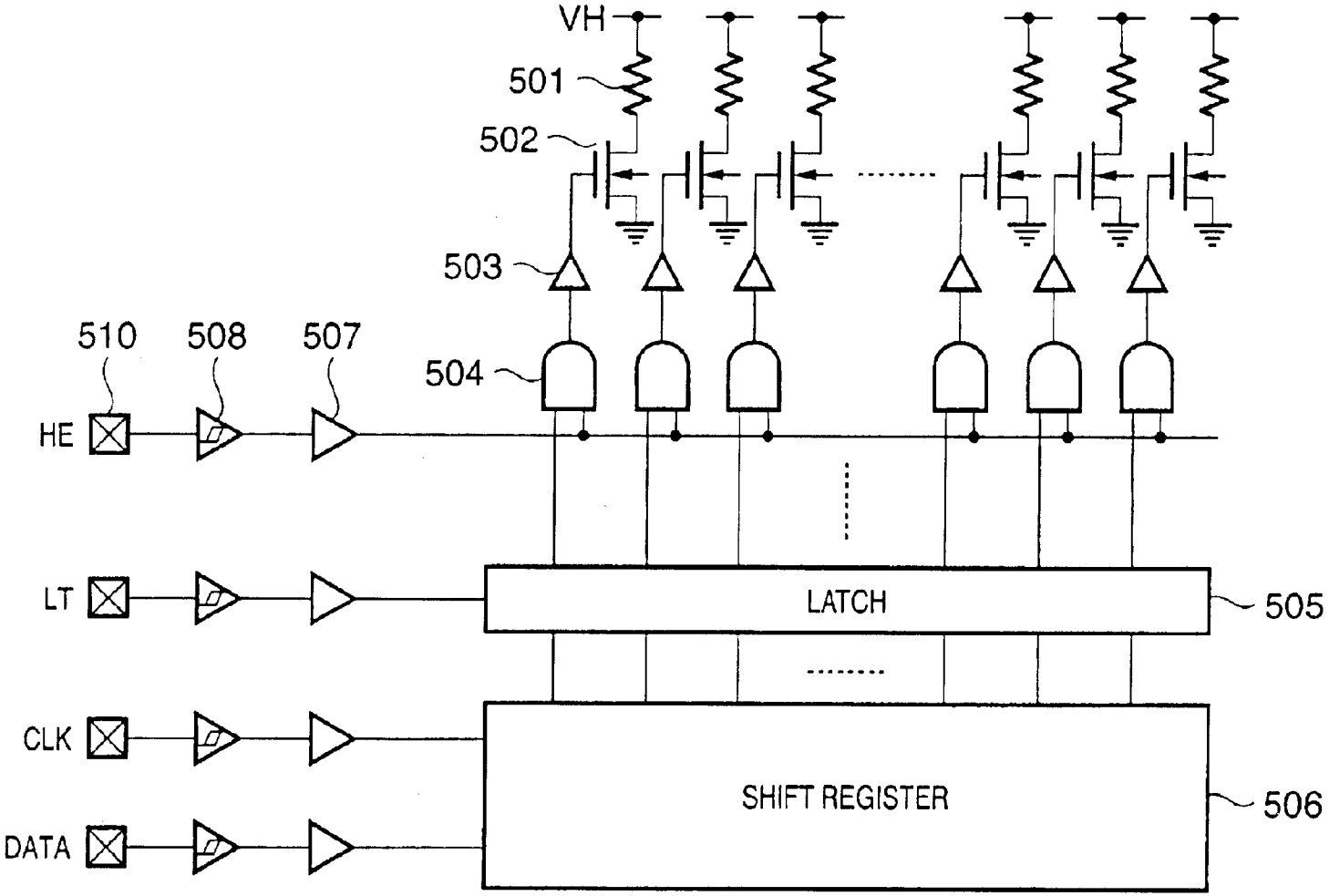
FIG. 1 is a block diagram showing the circuit structure of a heater board of a typical ink jet printhead.
Figure 2A:
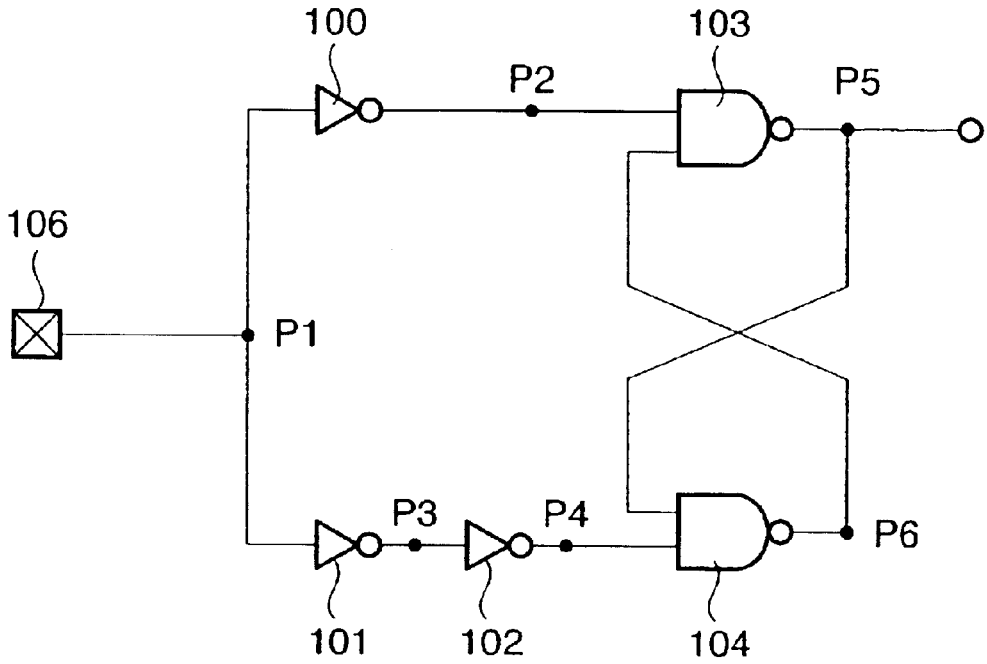
FIGS. 2A and 2B are diagrams illustrating a Schmitt trigger and the operating characteristics thereof.
Figure 2B:
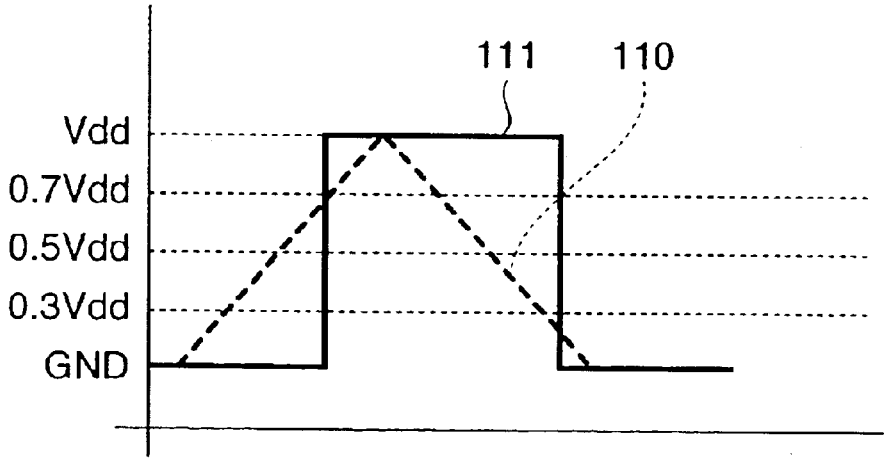
Figure 3:
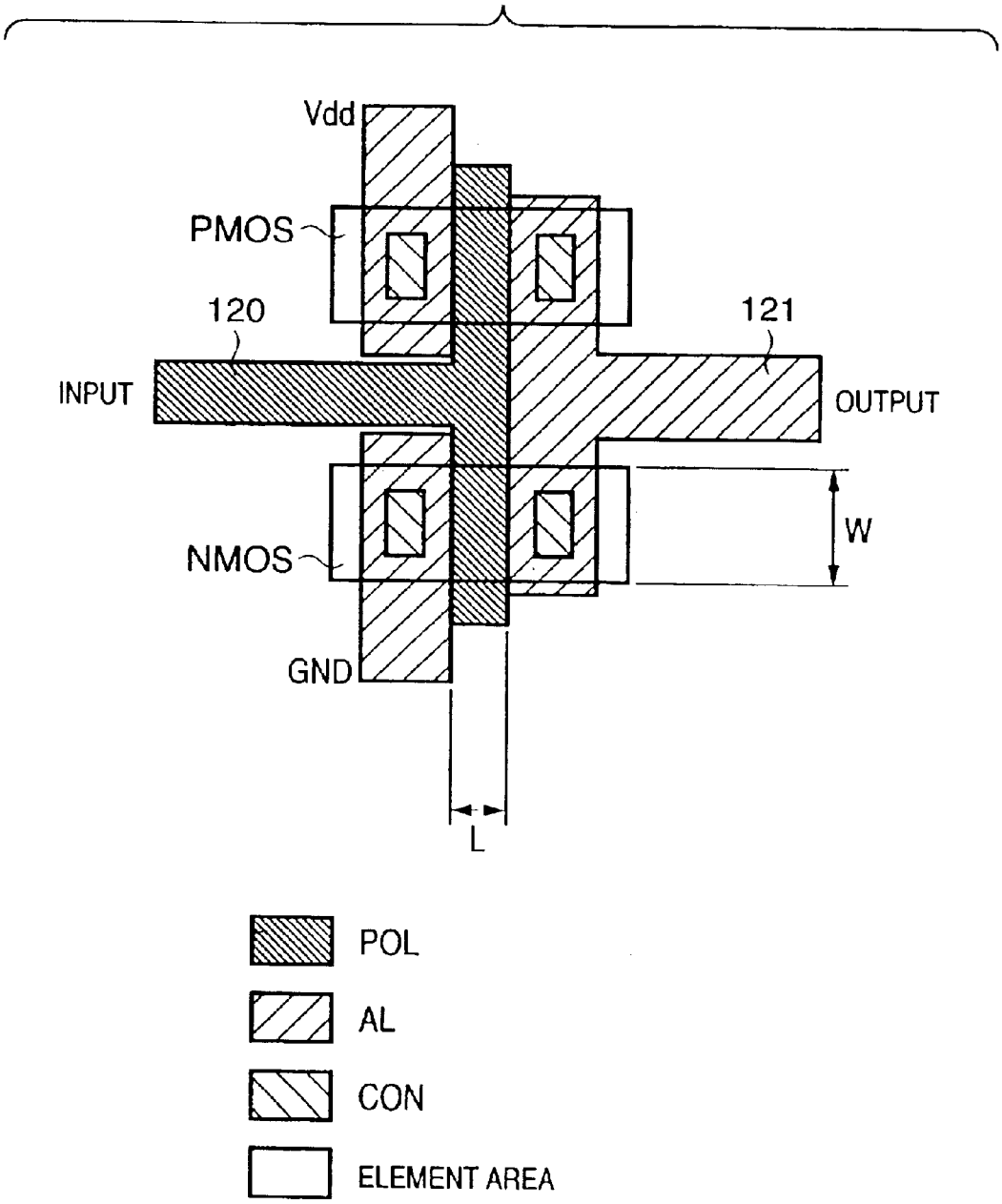
FIG. 3 shows the layout of a MOS inverter.
Figure 4:
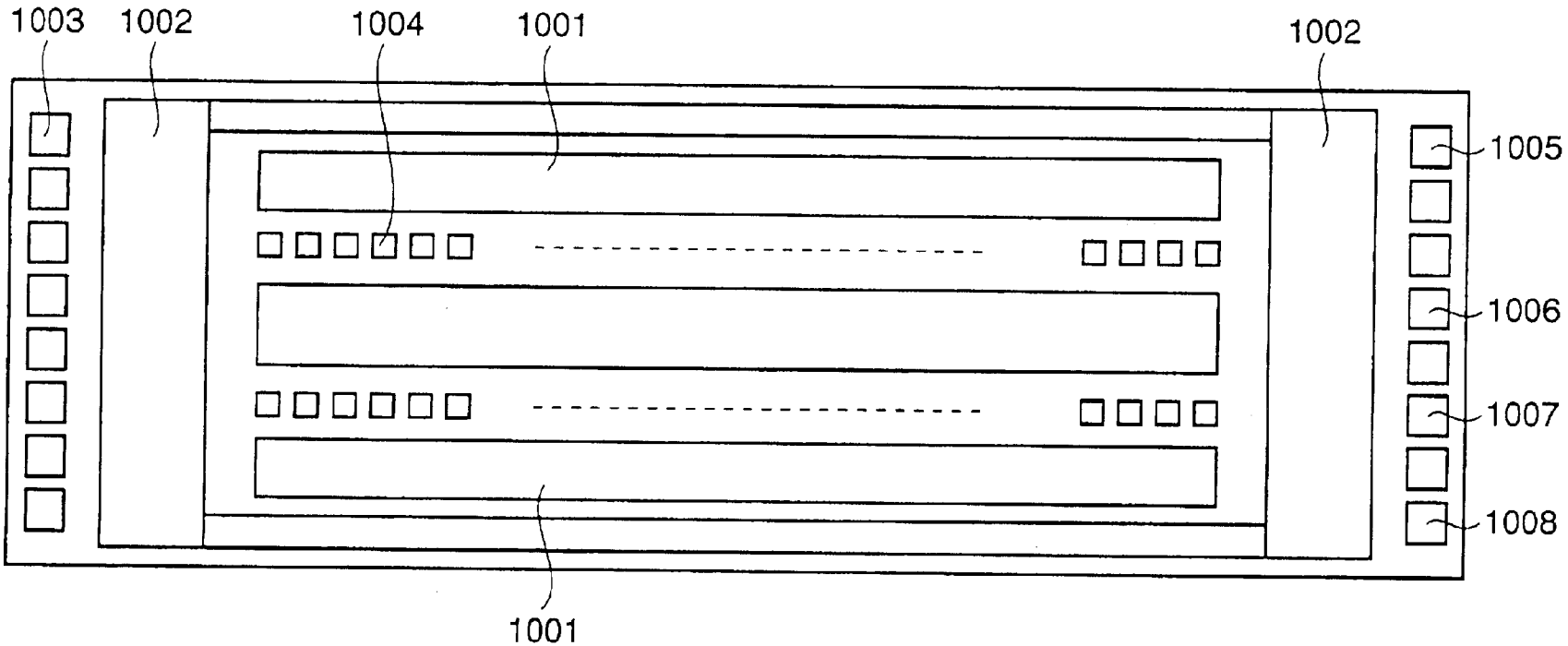
FIG. 4 is an example of the structure of the substrate (element board) used in a typical ink jet printhead.
Figure 5:
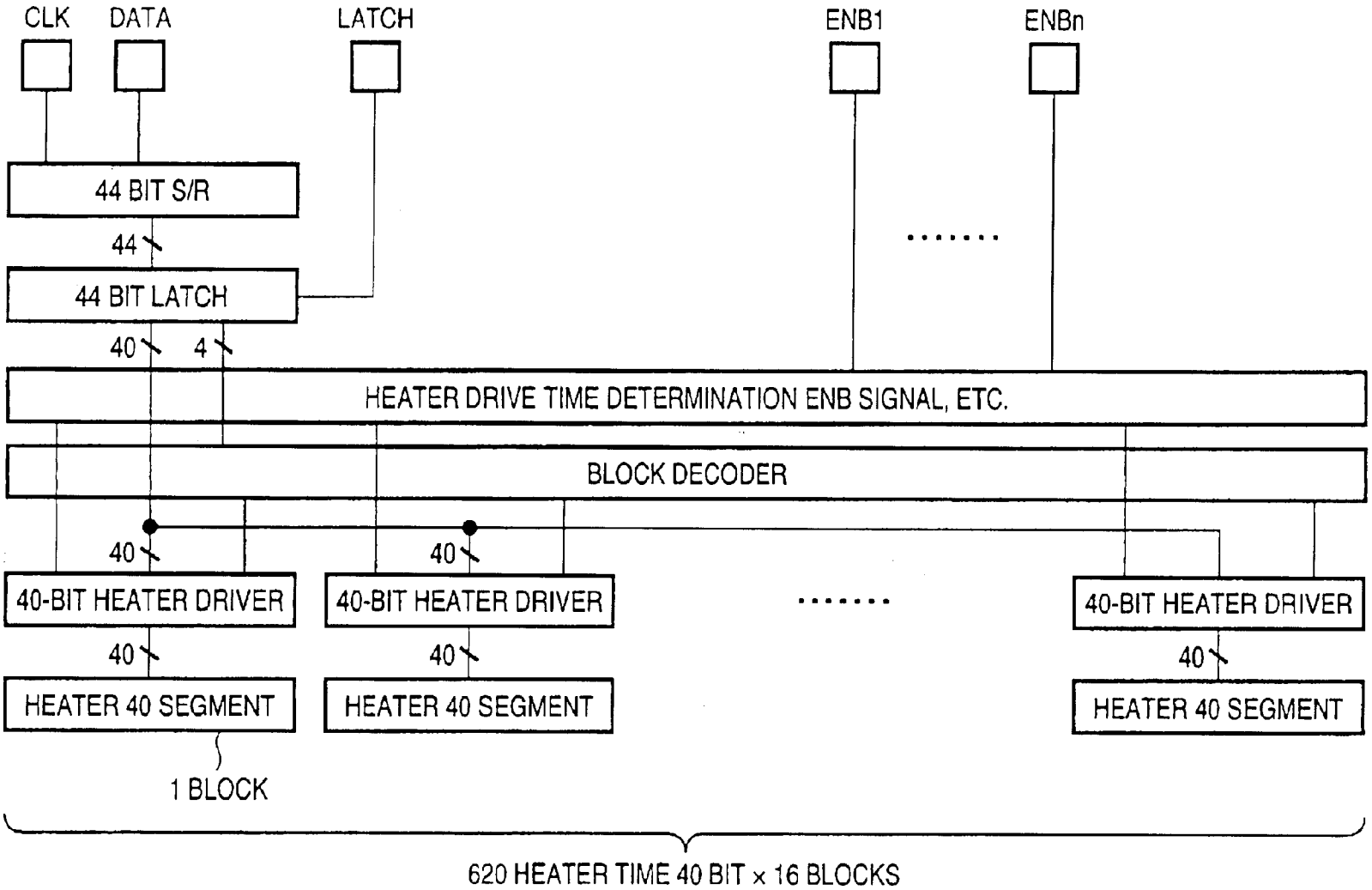
FIG. 5 is a block diagram of an ink jet printhead substrate.

As a means of adjusting the delay of the rising and falling waveform signals at the Schmitt trigger depicted in FIG. 2A, the present embodiment is provided with a condenser 801 connected to the output of inverter 100.

The condenser 801 corresponds to the input capacity C105 of the inverter 105 in the first embodiment described above. Accordingly, setting the capacity of the condenser 801 according to equation (4) above eliminates the difference in the delays of the rising and falling signals at the Schmitt trigger, thereby allowing the system to accommodate upgrades to high-speed data transfer.

Additionally, the Schmitt trigger of the present embodiment is one in which the condenser 801 which has been added to the circuit has the same structure as that which is used with conventional circuits. Therefore, the present embodiment can be formed on the heater board using the same manufacturing techniques as are used conventionally, thus keeping cost increases associated with the present embodiment to a minimum.

[Third Embodiment]

A description will now be given of a printhead according to a third embodiment. Such description concentrates on the distinctive features of the third embodiment, and so a description of elements of the third embodiment that are identical to those of the first and second embodiments described above is omitted.

Figure 16:
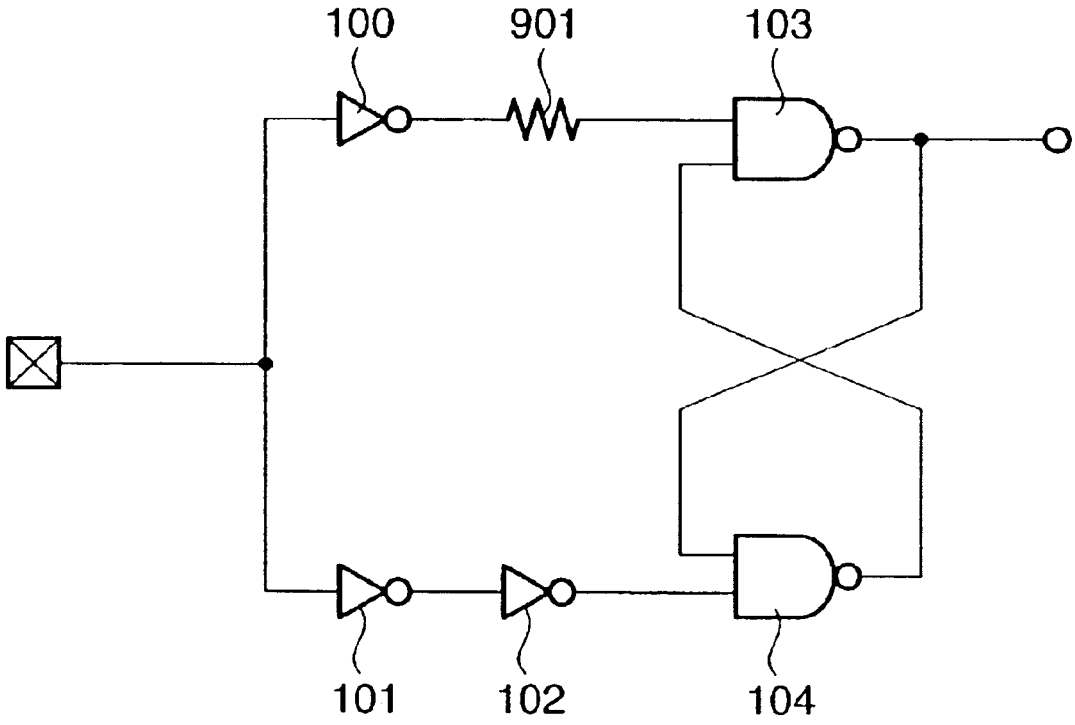
FIG. 16 is a circuit diagram showing the structure of a Schmitt trigger of a printhead according to a third embodiment of the present invention.

FIG. 16 is a circuit diagram showing the structure of a Schmitt trigger of the printhead according to the third embodiment of the present invention. As a means of adjusting the delay of the rising and falling waveform signals at the Schmitt trigger depicted in FIG. 2A, the present embodiment is provided with a resistor 901 connected to the output of inverter 100.

Assuming the ON resistance of the resistor 901 is R901 and the ON resistance and the input capacity of the other components are the same as those for the first embodiment as described above, then the rising waveform signal delay Tr at the Schmitt trigger of the present embodiment is $$Tr \propto (R100+R901)\times C103 \quad (5)$$

The falling waveform signal delay is the same as that of the equation (2) described above with respect to the first embodiment. Accordingly, R901 such that Tr=Tf can be solved using equations (5) and (2) as follows:

$$R901=((R101\times C102+R102\times C104)/C103)-R100 \quad (6)$$

Therefore, setting the value of R901 for resistor 901 so as to satisfy the terms of equation (6) eliminates the difference in the delays of the rising and falling signals at the Schmitt trigger, thereby allowing the system to accommodate upgrades to high-speed data transfer.

Additionally, the Schmitt trigger of the present embodiment is one in which the resistor 901 is added to a conventional Schmitt trigger, and therefore, the present embodiment can be formed on the heater board using the same manufacturing techniques as arc used conventionally, thus keeping cost increases associated with the present embodiment to a minimum.

[Fourth Embodiment]

A description will now be given of a printhead according to a fourth embodiment. Such description concentrates on the distinctive features of the fourth embodiment, and so a description of elements of the fourth embodiment that are identical to those of the first, second and third embodiments described above is omitted.

Figure 17:
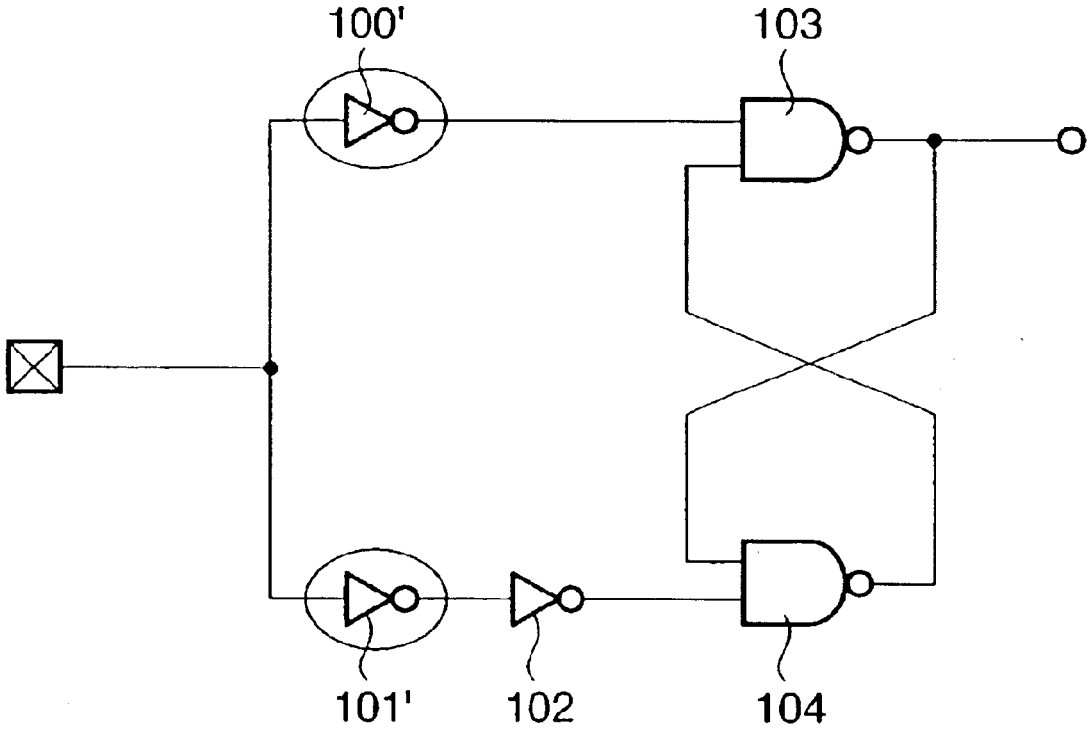
FIG. 17 is a circuit diagram showing the structure of a Schmitt trigger of a printhead according to a fourth embodiment of the present invention.

FIG. 17 is a circuit diagram showing the structure of a Schmitt trigger of the printhead according to the fourth embodiment of the present invention. Instead of inverters 100 and 101 of the Schmitt trigger depicted in FIG. 2A, the Schmitt trigger of the present embodiment is provided with inverters 100' and 101' whose ON resistances are adjusted when driven in order to adjust the time delay of the rising signal and the falling signal.

In the circuit shown in FIG. 17, if the ON resistance when driven of the inverter 100' is R100' and the ON resistance when driven of the inverter 101' is R101', then the rising delay Tr is $$Tr \propto R100'\times C103 \quad (7)$$

and the falling delay Tf is $$Tf \propto R101'\times C102+R102\times C104 \quad (8)$$

Accordingly, it is satisfactory to set the inverter 100' ON resistance R100' when driven and the inverter 101' ON resistance R101' when driven so as to satisfy the following equation:

$$R100'\times C103=R101'\times C102+R102\times C104 \quad (9)$$

Specifically, the MOS transistor size of the inverter 100' and the inverter 101' is set.

According to the present embodiment, setting the ON resistance R100' of the inverter 100' when driven and the ON resistance R101' of the inverter 101' when driven so as to satisfy equation (9) eliminates the difference in the delays of the rising and falling signals at the Schmitt trigger, thereby allowing the system to accommodate upgrades to high-speed data transfer.

In the above-described case, it is not necessary to adjust both values R100' and R101'. Rather, it is sufficient to adjust one of these two values so as to satisfy equation (9).

Additionally, the Schmitt trigger of the present embodiment has essentially the same composition as the conventional Schmitt trigger, and thus can be formed on the heater board using conventional manufacturing techniques, which means that no additional costs are incurred in production of the present embodiment.

<Other Embodiments>

Each of the embodiments described above has exemplified a printer, which comprises means (e.g., an electrothermal transducer, laser beam generator, or the like) for generating heat energy as energy utilized upon execution of ink discharge, and causes a change in state of an ink by the heat energy, among the ink-jet printers. According to this ink-jet printer and printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796, is preferable. The above system is applicable to either one of a so-called on-demand type and a so-called continuous type. Particularly, in the case of the on-demand type, the system is effective because, by applying at least one driving signal, which corresponds to printing information and gives a rapid temperature rise exceeding nucleate boiling, to each of electrothermal transducers arranged in correspondence with a sheet or liquid channels holding a liquid (ink), heat energy is generated by the electrothermal transducer to effect film boiling on the heat-acting surface of the printhead, and consequently, a bubble can be formed in the liquid (ink) in one-to-one correspondence with the driving signal.

By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat-acting surface.

As an arrangement of the printhead, in addition to the arrangement of a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose an arrangement having a heat-acting portion arranged in a flexed region, is also included in the present invention.

Furthermore, as a full-line type printhead having a length corresponding to the width of a maximum printing medium which can be printed by the printer, either an arrangement which satisfies the full-line length by combining a plurality of printheads as disclosed in the above specification or an arrangement as a single printhead obtained by forming printheads integrally can be used.

In addition, the present invention is applicable not only to an exchangeable chip type printhead, as described in the above embodiment, which can be electrically connected to the apparatus main unit and can receive ink from the apparatus main unit upon being mounted on the apparatus main unit, but also to a cartridge type printhead, in which an ink tank is integrally arranged on the printhead itself.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printhead or by combining a plurality of printheads.

The present invention can be applied to a system constituted by a plurality of devices (e.g., host computer, interface, reader, printer) or to an apparatus comprising a single device (e.g., copying machine, facsimile machine).

As many apparently widely different embodiments of the present invention can be made without departing from the spirit and scope thereof, it is to be understood that the present invention is not limited to the specific preferred embodiments thereof described above, except as defined in the claims.

What is claimed is:

1. A printhead in which a plurality of printing elements and a drive circuit for driving the printing elements are provided on a single element substrate, the printhead comprising:

a Schmitt trigger including two paths with different numbers of inverters and having hysteresis characteristics that cause a threshold value for a rising edge of a waveform of a logic signal inputted into the drive circuit and a threshold value of a falling edge of a waveform of a logic signal inputted into the drive circuit to be different; and delay adjustment means for adjusting a length of a delay of the path having fewer inverters so as to make the length of the delay of the path having fewer inverters longer.

2. The printhead according to claim 1, wherein data is read at the rising edge and the falling edge of the logic signal.

3. The printhead according to claim 2, wherein the logic signal includes at least a clock signal (CLK) and a data signal (DATA).

4. The printhead according to claim 1, wherein the delay adjustment means is provided inside the Schmitt trigger.

5. The printhead according to claim 4, wherein a Schmitt trigger is provided for each logic signal inputted into the drive circuit.

6. The printhead according to claim 4, wherein the Schmitt trigger is configured so that the number of elements along a path traversed by the rising edge of the logic signal and the number of elements along a path traversed by the falling edge of the logic signal are different, and the delay adjustment means is provided along the path having fewer elements.

7. The printhead according to clam 6, wherein the Schmitt trigger is configured so that the number of inverters included in the path traversed by the falling edge of the logic signal is greater than the number of inverters included in the path traversed by the rising edge of the logic signal, and the delay adjustment means is provided along the path traversed by the rising edge of the logic signal.

8. The printhead according to claim 6, wherein the Schmitt trigger is configured so that the number of inverters included in the path traversed by the falling edge of the logic signal is greater than the number of inverters included in the path traversed by the rising edge of the logic signal, and the length of the delay at the rising edge of the waveform logic signal and the length of the delay at the falling edge of the waveform logic signal are adjusted by adjusting an ON resistance of at least one inverter included in one path or the other.

9. The printhead according to claim 1, wherein the delay adjustment means is an inverter.

10. The printhead according to claim 1, wherein the delay adjustment means is a condenser.

11. The printhead according to claim 1, wherein the delay adjustment means is a resistor.

12. The printhead according to claim 1, wherein the delay adjustment means adjusts the length of the delay at the rising edge and the length of the delay at the falling edge, so that the length of the delay at the rising edge and the length of the delay at the falling edge are substantially identical.

13. The printhead according to claim 1, wherein the printhead is an ink jet printhead tat performs printing by using the printing elements to discharge ink.

14. The printhead according to claim 13, wherein the printing elements are electrothermal converters that generate thermal energy that is used to discharge ink.

15. A head cartridge comprising:

a printhead in which a plurality of printing elements and a drive circuit for driving the printing elements are provided on a single element substrate; and an ink tank adapted to hold ink to be supplied to the printhead, wherein said printhead comprises:

a Schmitt trigger including two paths with different numbers of inverters and having hysteresis characteristics that cause a threshold value for a rising edge of a waveform of a logic signal inputted into the drive circuit and a threshold value of a falling edge of a waveform of a logic signal inputted into the drive circuit to be different, and delay adjustment means for adjusting a length of a delay of the path having fewer inverters so as to make the length of the delay of the path having fewer inverters longer.

16. A printing apparatus comprising a printhead and performing printing by using the printhead, wherein said printhead comprises:

a Schmitt trigger including two paths with different numbers of inverters and having hysteresis characteristics that cause a threshold value for a rising edge of a waveform of a logic signal inputted into the drive circuit and a threshold value of a falling edge of a waveform of a logic signal inputted into the drive circuit to be different, and delay adjustment means for adjusting a length of a delay of the path having fewer inverters so as to make the length of the delay of the path having fewer inverters longer.

17. A printhead element substrate, in which a plurality of printing elements and a drive circuit for driving the printing elements are provided on a single element substrate, the printhead element substrate comprising:

a Schmitt trigger including two paths with different numbers of inverters and having hysteresis characteristics that cause a threshold value for a rising edge of a waveform of a logic signal inputted into the drive circuit and a threshold value of a falling edge of a waveform of a logic signal inputted into the drive circuit to be different; and delay adjustment means for adjusting a length of a delay of the path having fewer inverters so as to make the length of the delay of the path having fewer inverters longer.

* * * * *

UNITED STATES PATENT AND TRADEMARK OFFICE

CERTIFICATE OF CORRECTION

PATENT NO. : 6,824,237 B2
DATED : November 30, 2004
INVENTOR(S) : Nobuyuki Hirayama et al.

It is certified that error appears in the above-identified patent and that said Letters Patent is hereby corrected as shown below:

Title page,
Item [56], References Cited, U.S. PATENT DOCUMENTS, insert:
-- 6,335,649 1/2002 MAEDA
5,327,020 6/1994 IKEDA
6,351,179 2/2002 IKCEHASHI ET AL. --.
FOREIGN PATENT DOCUMENTS, "JP 362007216 A" should read
-- JP 62-007216 A --; and
"JP 8-39809 2/1996" should be deleted.

Figure 6:
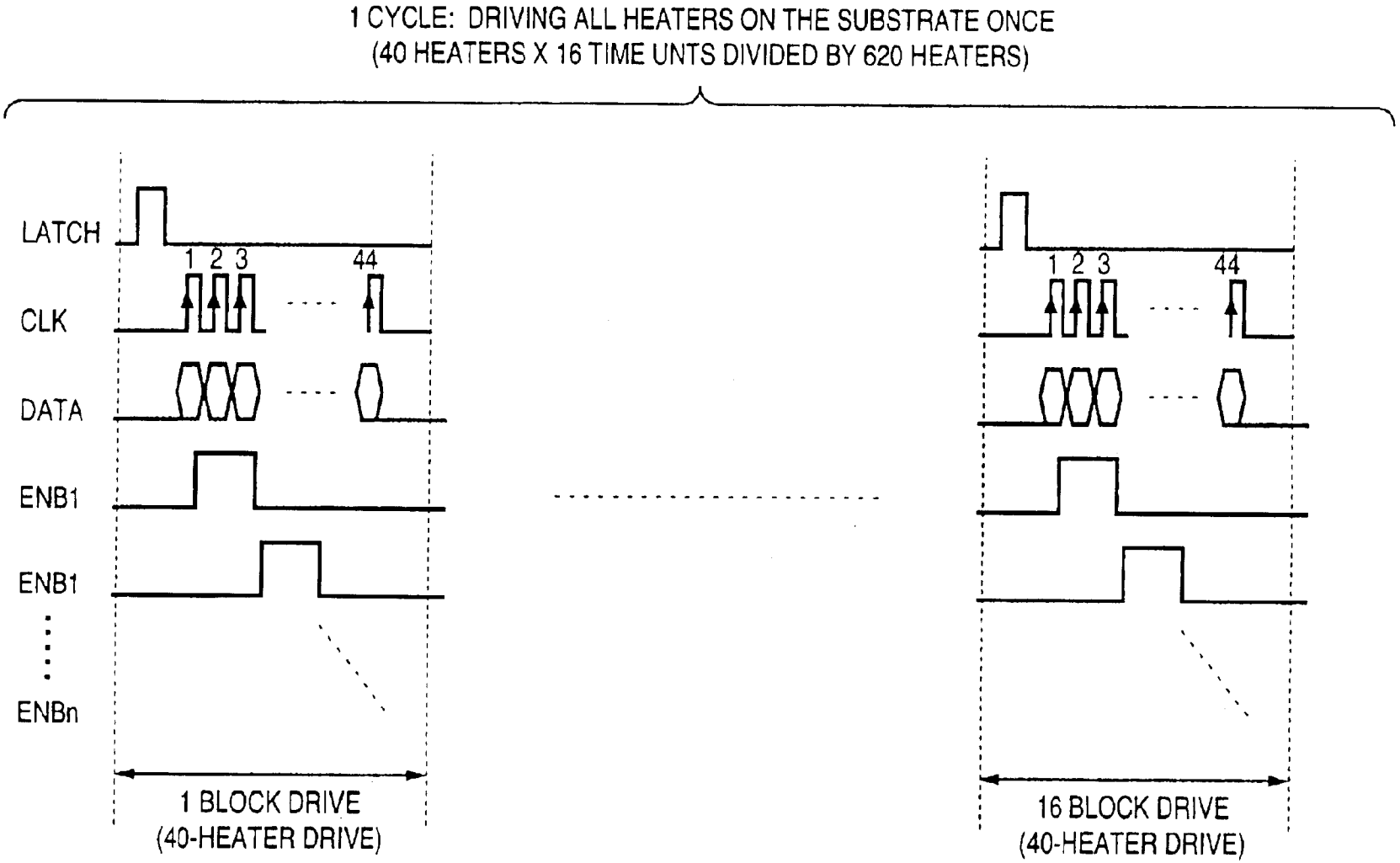
FIG. 6 is a drive timing chart for an ink jet printhead substrate.
Figure 7A:
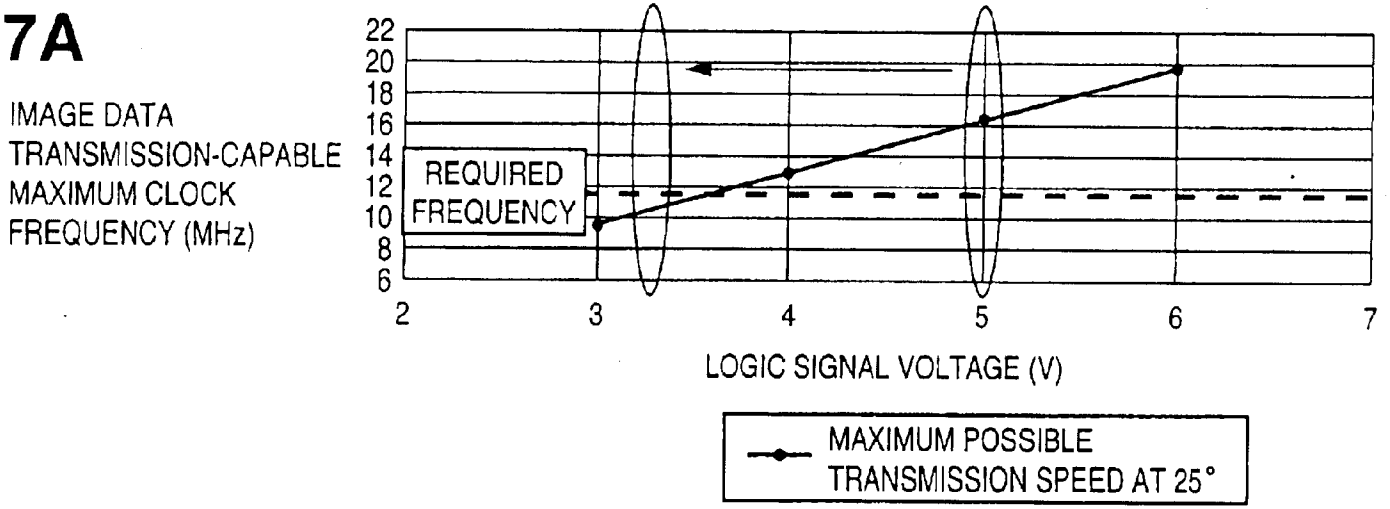
FIGS. 7A and 7B are diagrams showing logic supply voltage versus image data transmission-capable maximum clock frequency and element board temperature versus image data transmission-capable maximum clock frequency, respectively.
Figure 7B:
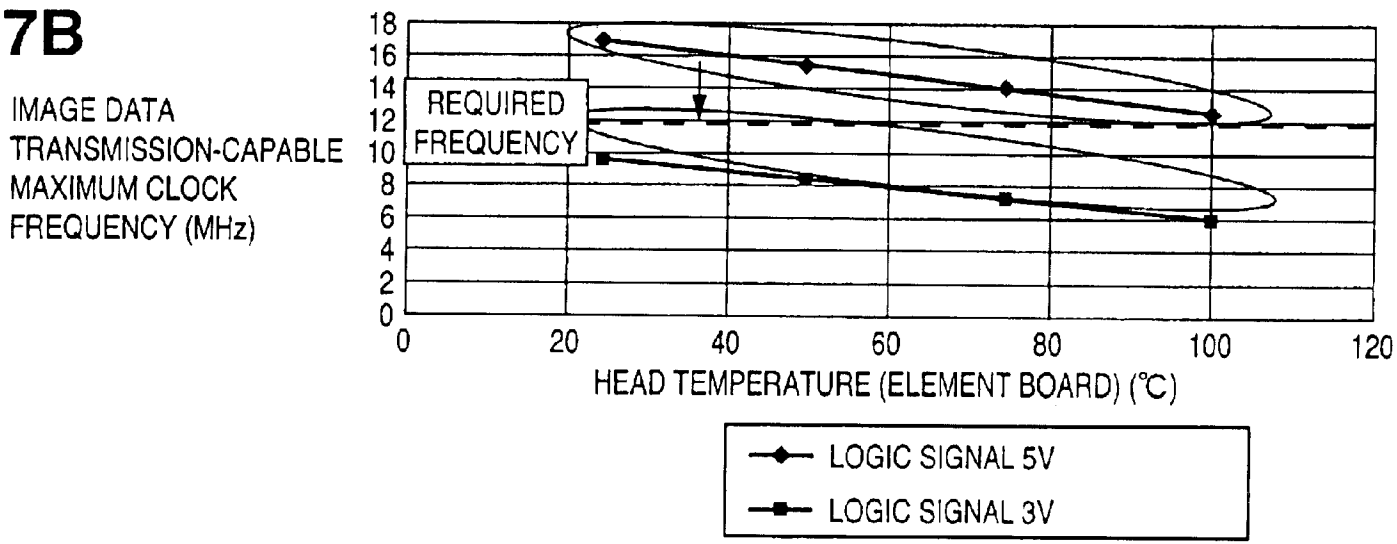
Figure 8:
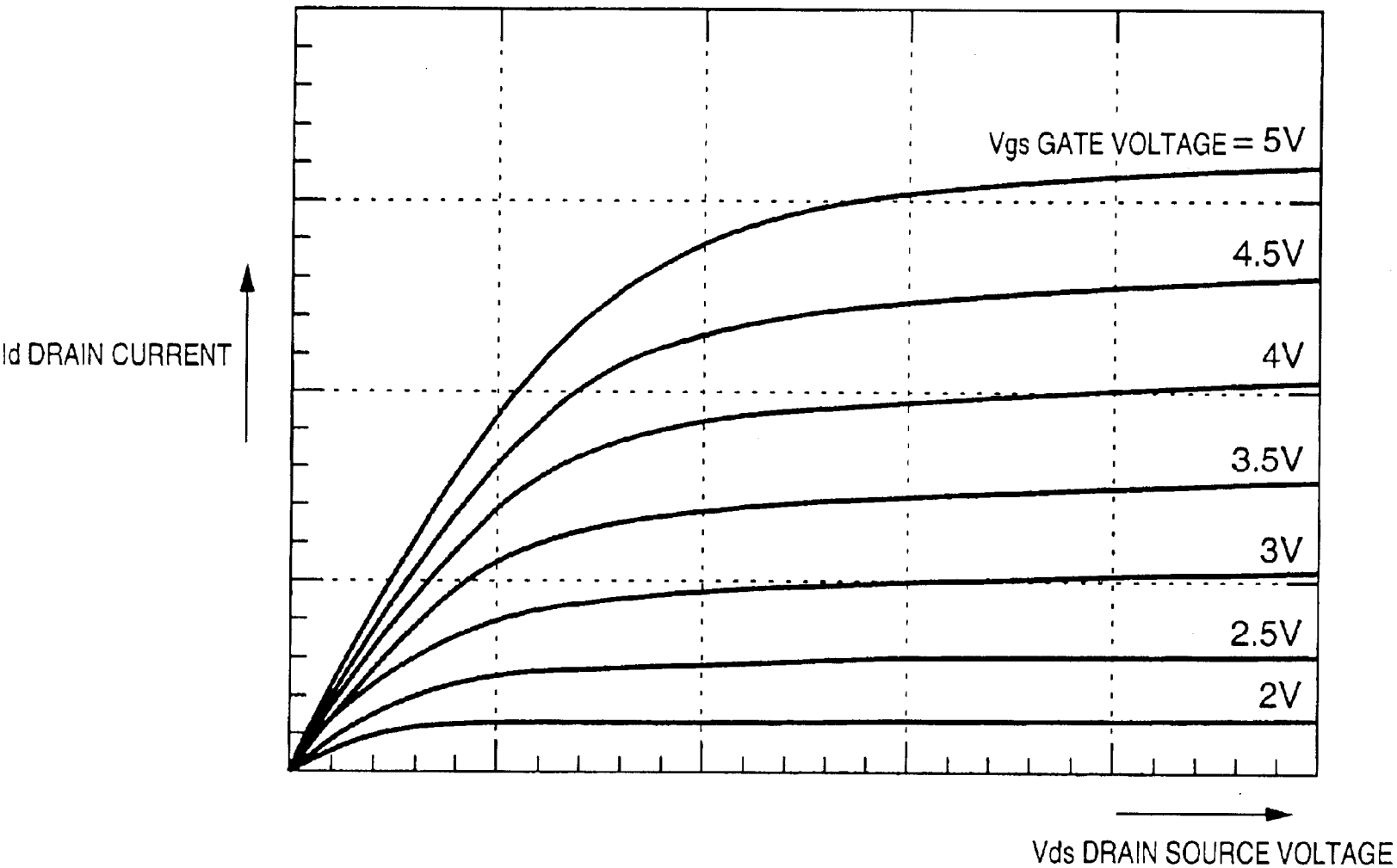
FIG. 8 is a graph showing the relation between drain current ($I_d$) and drain-source voltage ($V_{ds}$) in a MOS transistor when the gate voltage ($V_{gs}$) is varied.
Figure 9:
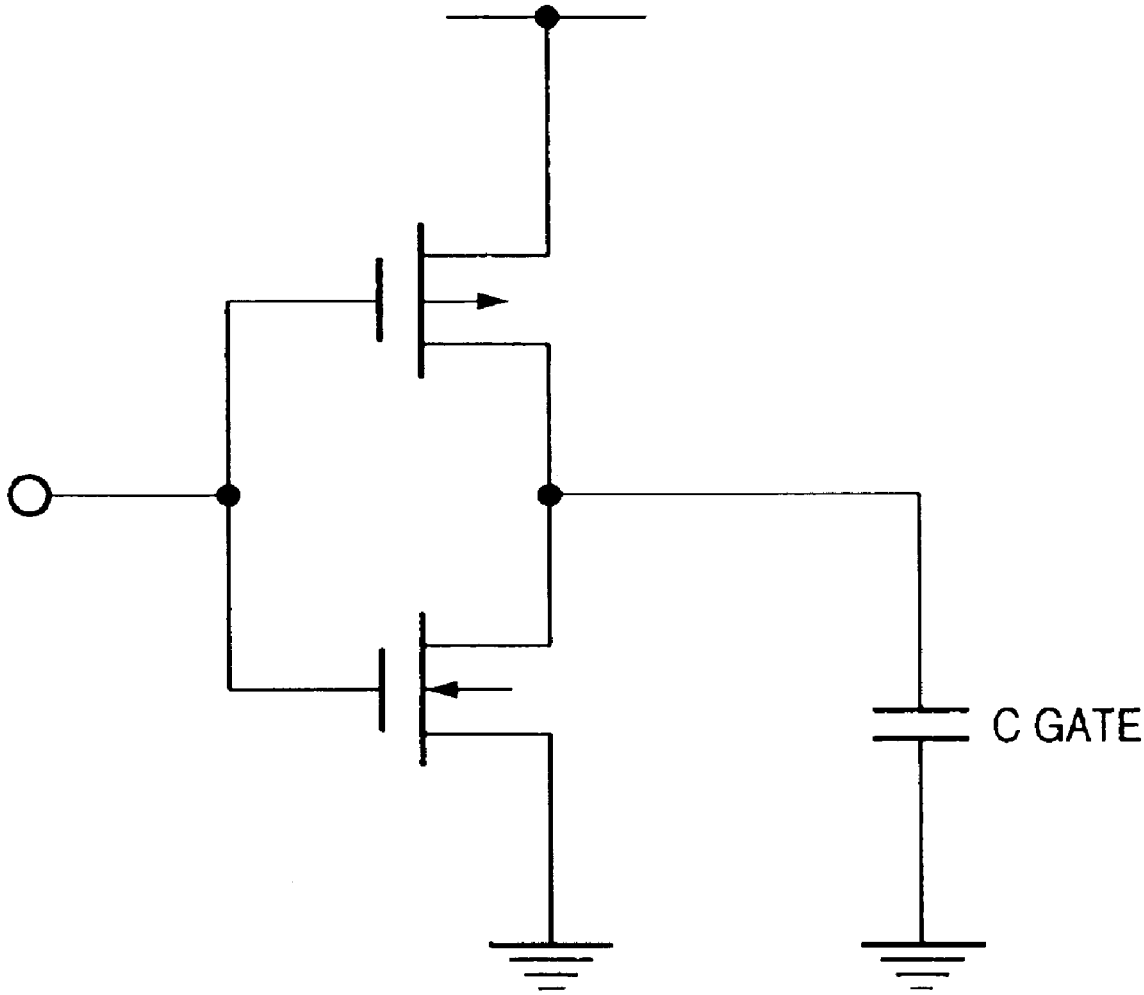
FIG. 9 is a diagram showing the gate capacity load added to the inverter output when a CMOS inverter is used to drive a MOS transistor gate.
Figure 10:
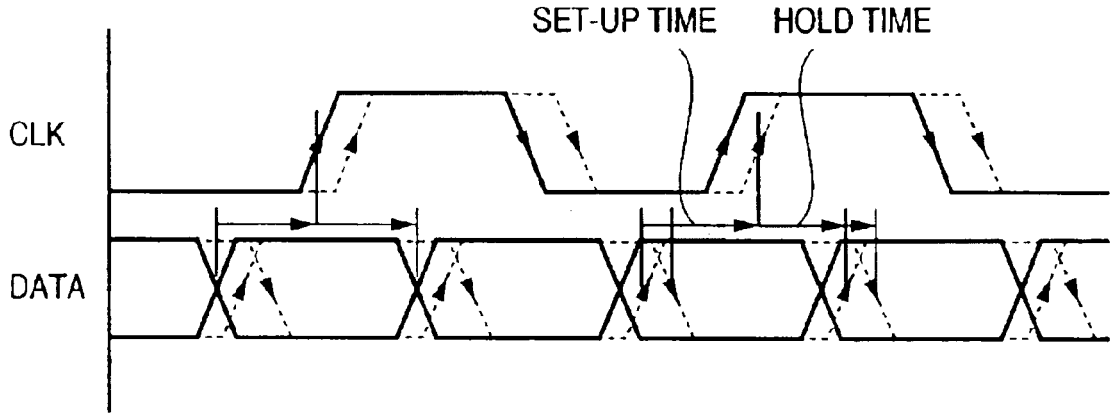
FIG. 10 shows a Schmitt trigger signal waveform in which a delay is imposed at the rising and failing edges of an input signal.

Drawings,
SHEET 6, Figure 6, "UNTS" should read -- UNITS --.

Column 1,
Line 53, "causes" should read -- cause --.

Column 2,
Line 50, "resistance" should read -- resistances --; and
Line 51, "is" (both occurrences) should read -- are --.

Column 3,
Line 12, "(PS)" should read -- (P5) --.

Column 5,
Line 39, "is" should read -- are --.

Column 7,
Line 7, "is" should read -- are --; and
Line 63, "failing" should read -- falling --.

Column 8,
Line 45, ""clement" should read -- "element --.

Column 14,
Line 34, "clam" should read -- claim --; and
Line 63, "tat" should read -- that --.

Column 15,
Line 14, "different," should read -- different; and --; and
Line 15, "and delay" should read -- ¶delay --.

UNITED STATES PATENT AND TRADEMARK OFFICE

CERTIFICATE OF CORRECTION

PATENT NO. : 6,824,237 B2
DATED : November 30, 2004
INVENTOR(S) : Nobuyuki Hirayama et al.

It is certified that error appears in the above-identified patent and that said Letters Patent is hereby corrected as shown below:

Column 16,
Line 4, "different," should read -- different; and --; and
Line 5, "and delay" should read -- ¶delay --.

Signed and Sealed this

Seventh Day of June, 2005

JON W. DUDAS
*Director of the United States Patent and Trademark Office*